US007753476B2

(12) United States Patent
Shindo

(10) Patent No.: US 7,753,476 B2
(45) Date of Patent: Jul. 13, 2010

(54) IMAGE RECORDING APPARATUS

(75) Inventor: Tatsuya Shindo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 854 days.

(21) Appl. No.: 11/580,727

(22) Filed: Oct. 13, 2006

(65) Prior Publication Data

US 2007/0085874 A1 Apr. 19, 2007

(30) Foreign Application Priority Data

Oct. 18, 2005 (JP) ..... 2005-303328

(51) Int. Cl.
*B41J 2/165* (2006.01)

(52) U.S. Cl. ..... 347/30

(58) Field of Classification Search ..... 347/29, 347/33

See application file for complete search history.

(56) References Cited

U.S. PATENT DOCUMENTS 6,582,054 B2 6/2003 Yamamoto et al.
6,631,973 B1 * 10/2003 Edamura ..... 347/30
6,733,117 B2 * 5/2004 Tajima et al. ..... 347/87
2002/0105555 A1 * 8/2002 Tsukada et al. ..... 347/7
2003/0227505 A1 * 12/2003 Tanaka et al. ..... 347/29

FOREIGN PATENT DOCUMENTS

JP 63115755 5/1988
JP 63115755 A * 5/1988
JP 3193461 8/1991
JP 2002-36606 6/2002

* cited by examiner

*Primary Examiner*—Stephen D Meier
*Assistant Examiner*—Alexander C Witkowski
(74) *Attorney, Agent, or Firm*—Frommer Lawrence & Haug LLP

(57) ABSTRACT

An image recording apparatus includes: an ink jet head having a plurality of nozzles for discharging inks; a cap body having an inner space and adapted to cover open surfaces of the nozzles such that the inner space forms a sealed space; a sucking device which is connected to the inner space of the cap body and sucks the ink from the nozzles; a cap body driver which switches a position of the cap body between a first position where the cap body is in contact with the open surfaces of the nozzles and a second position where the cap body is separated from the open surfaces of the nozzles; and a controller which controls a timing when the cap body driver switches the position of the cap body from the first position to the second position, on the basis of an ink amount to be sucked from the nozzles.

13 Claims, 13 Drawing Sheets

IMAGE RECORDING APPARATUS

CROSS-REFERENCE TO RELATED APPLICATIONS

This Nonprovisional application claims priority under 35.U.S.C. §119(a) on Patent Application No. 2005-303328 filed in Japan on Oct. 18, 2005, the entire contents of which are hereby incorporated by reference.

BACKGROUND

The present invention relates to an image recording apparatus of an ink jet type that discharges ink from a nozzle and records an image on a recording medium.

Conventionally, as an image recording apparatus, there is a type that records an image by reciprocating a carriage, which contains an ink jet head for discharging ink from a nozzle and recording on a recording medium, in a direction orthogonal to a feeding direction of the recording medium. In the image recording apparatus of the ink jet type, a maintenance operation for sucking and removing the bubble staying inside the ink jet head, the ink hardened by dryness, and the like, from the nozzle side is carried out in order to maintain a discharging performance. For this reason, the image recording apparatus usually contains a maintenance unit, outside a record region where the ink jet head (carriage) records on the recording medium while moving therefore, and near the movement end of the ink jet head (carriage).

The maintenance unit contains a cap body, which is connected to and separated from the open surface of the nozzle. When the ink jet head is separated from the record region and moved to the position of the cap body, the cap body approaches the open surface of the nozzle and covers this. Then, the sucking operation and the like are carried out by a sucking pump connected to the cap body. The cap body is usually made of a rubber-shaped elastic body, and a protrusion towards the nozzle open surface side is formed. So as to surround the openings of the plurality of nozzles, the protrusions are adhered to the nozzle open surfaces.

On the other hand, the installed ink jet head is designed such that in association with the colorization in recent years, not only a black ink but also a plurality of color inks (for example, a yellow ink, a magenta ink and a cyan ink) can be installed, thereby discharging an ink color different for each nozzle row composed of a plurality of nozzles. However, as for the degree of the clogging of the nozzle and the like, for example, kinds (characteristics) of the inks of a dye group, a pigment group and the like are different for each nozzle row. Thus, when the maintenances of all of the nozzles were set under the same time and the same suck pressure, the useless sucking was performed on the nozzle whose clogging degree was little, which resulted in a problem that the sucked discarded ink amount was useless and the maintenance time was useless.

So, Japanese Patent Publication No. 2805361 discloses a configuration that contains: a plurality of caps for capping respective discharging ports (nozzles) of an ink jet head (recording head); and a plurality of sucking pumps for sucking from the corresponding discharging port when the cap caps the corresponding discharging port, where the maximum suck pressure when the plurality of sucking pumps are used to suck is made different, in accordance with a kind of a liquid or an aperture of the discharging port.

On the other hand, Japanese Patent Application Laid-Open No. 2002-36606 discloses a configuration that contains: a cap for capping respective discharging ports (nozzles) of an ink jet head (recording head) in which a plurality of nozzle rows including a plurality of discharging ports are installed; linkage valves for linking an inner space of the cap to atmosphere; and sucking pumps for sucking through the linkage valves from the discharging ports, where the cap is formed as the integral type so that the inner space is divided into a plurality of components, correspondingly to the plurality of nozzle rows, and the plurality of linkage valves are installed so as to be individually linked to the plurality of inner spaces, and an opening/closing unit of the linkage valve which, when the cap is brought into contact with the discharging port surface of the recording head, closes from or links to the atmosphere for each inner space.

All of them can adjust the ink suck amount for each nozzle row, on the basis of the thick or thin aperture of the discharging port and the characteristic of the ink, and consequently protect the ink from being uselessly sucked.

SUMMARY

However, according to the configuration of Japanese Patent Publication No. 2805361, the plurality of sucking pumps were required, which resulted in the problem that the structure of the recovery apparatus of the recording head became complex and large in scale.

On the other hand, according to the configuration of Japanese Patent Application Laid-Open No. 2002-36606, this had the problem that the plurality of linkage valves were required and the configuration for controlling the timing when each linkage valve was opened/closed became complex.

It is therefore an object to provide an image recording apparatus that can adjust an ink suck amount for each group of a plurality of nozzles, in a simple configuration, and rapidly carry out a recovery operation.

In order to attain this object, the image recording apparatus, comprises: an ink jet head having a plurality of nozzles for discharging inks; a cap body having an inner space and adapted to cover open surfaces of the nozzles such that the inner space forms a sealed space; sucking device which is connected to the inner space of the cap body and sucks the ink from the nozzles; a cap body driver which switches a position of the cap body between a first position where the cap body is in contact with the open surfaces of the nozzles and a second position where the cap body is separated form the open surfaces of the nozzles; and a controller which controls a timing when the cap body driver switches the position of the cap body from the first position to the second position, on the basis of an ink amount to be sucked from the nozzles.

The control that can change the timing when the position of the cap body is switched from the first position (the position where the cap body is in contact with the open surfaces of the nozzles) to the second position (the position where the cap body is separated from the open surfaces of the nozzles), on the basis of the ink amount to be sucked from the nozzles is executed. Thus, as compared with the conventional operation for releasing the negative pressure caused by the switching valve installed in the middle of the tube through which the sucking pump and the cap body are connected (opening the inner space of the cap body so that it becomes at the atmosphere pressure), it is possible to reduce the recovery operation time including the wiping after the cap release.

The above and further objects and features of the invention will more fully be apparent from the following detailed description with accompanying drawings.

DETAILED DESCRIPTION OF THE EXEMPLARY EMBODIMENTS

The present invention will be described below in detail in accordance with the drawings showing the embodiment thereof. It is noted that the following embodiment is only one example, and it is natural that the embodiment can be suitably changed within the range that the scope of the present invention is not changed.

Figure 1:
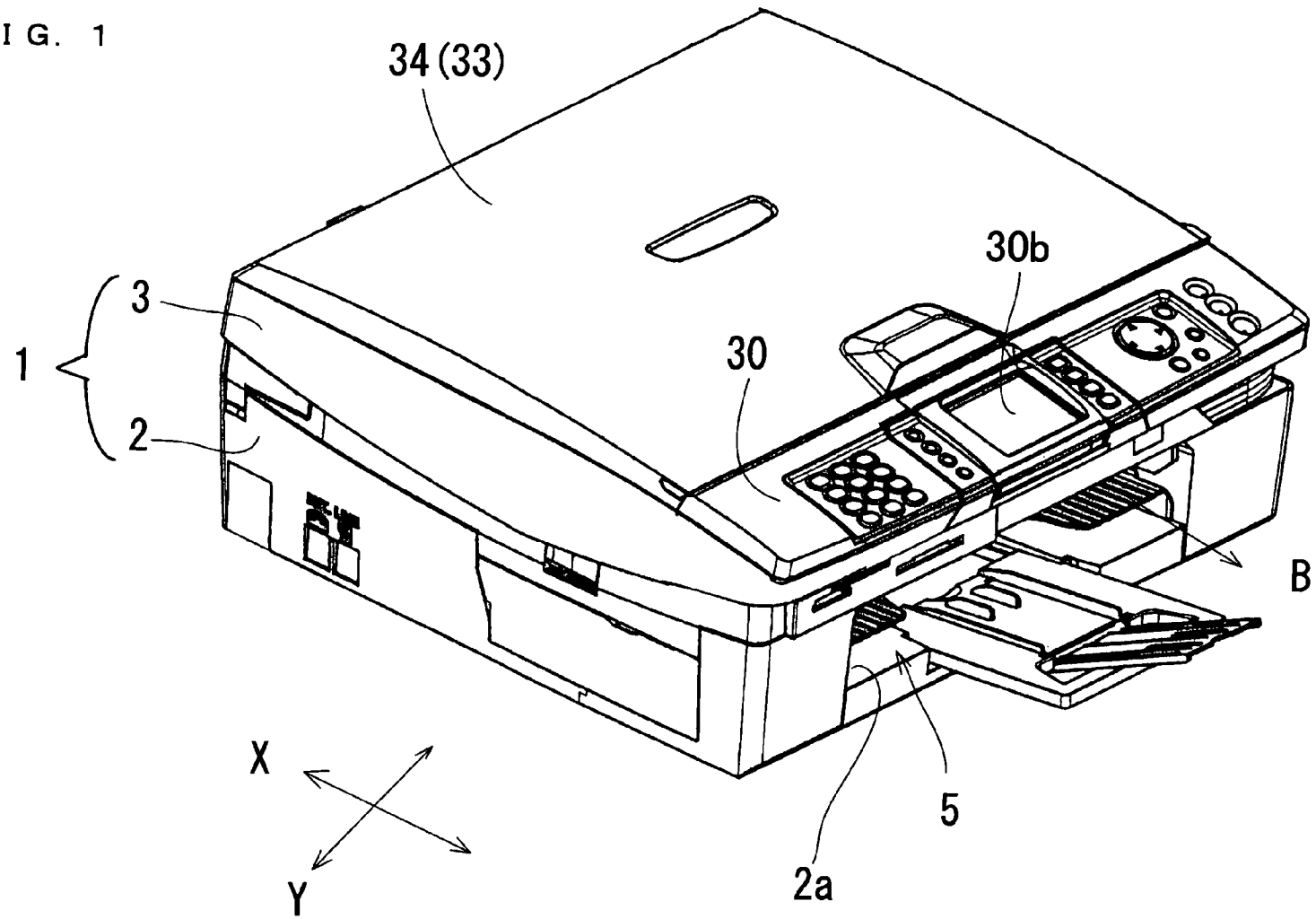
FIG. 1 is an entirely perspective view of an image recording apparatus.

An image recording apparatus 1 of a multi function device shown in FIG. 1 has a facsimile function, a printer function, a copy function, a scanner function and the like. The image recording apparatus 1 contains: a body case 2 which has the substantial shape of a box and whose top surface is opened; an upper case 3 which is installed so as to be able to be rotated upwardly and downwardly through a rotation axis line unit (not shown), such as a hinge, a hinge unit or the like, onto one side (the left side in the embodiment in FIG. 1) of this body case 2. In the following explanation, it is noted that the near side of the image recording apparatus 1 in FIG. 1 is defined as a front side and that the orientation of the image recording apparatus 1 in FIG. 1 is defined as a standard even with respect to the right and left direction (a main scanning direction: a Y-axis direction), a forward and backward direction (a sub-scanning direction: an X-axis direction) and an upward and downward direction. The body case 2 and the upper case 3 are the injection mold products made of synthetic resins.

An operation panel 30 is placed on the front of the top surface of the upper case 3. Various buttons, such as numeral buttons, a start button, function operation buttons and the like, are installed on the operation panel 30. When those buttons are pushed down, various operations are executed. A liquid crystal display 30*b* is placed on the operation panel 30. The setting states and various operation messages and the like of the image recording apparatus 1 are displayed as necessary. In the upper case 3, a scanner device (image reader) 33 is placed on the rear side of the operation panel 30. That is, the scanner device 33 for reading the facsimile document to be transmitted to a partner facsimile apparatus at the time of the facsimile function and the image of a document to be copied at the time of the copy function has: a flat bed reader for reading the image of the document on a large glass plate; and a rotatable cover body 34 that covers the top surface of this flat bed reader.

Although not shown, immediately under the glass plate in the flat bed reader, an image sensor (CIS: Contact Image Sensor) of an adhesive type of a line type as one example of a photoelectric conversion element for reading the image plane of the document brought into contact with the glass plate is installed so as to be able to reciprocate along a guide shaft extended in the direction (the sub-scanning direction: the X-axis direction) orthogonal to the movement direction (the main scanning direction: the Y-axis direction) of the carriage, which will be described later. It is noted that the cover body 34 is configured so as to be rotated in an openable/closable manner through the hinge with the rear side (the depth side in FIG. 1) of the image recording apparatus 1 as a center.

The configuration of the printer device (the recorder) will be described below. As shown in FIG. 1, a paper supply cassette 5, in which papers P as a plurality of record media are placed in the substantially horizontally deposited state, is installed in the bottom of the center in the right and left direction inside the body case 2. This paper supply cassette 5 is configured so as to be able to be pulled out for an opening 2*a* on the front of the body case 2. In this embodiment, the paper supply cassette 5 is assumed such that the plurality of papers P serving as the recording media, which are cut to, for example, A4 sizes, letter sizes, legal sizes, postcard sizes and the like, can be piled (deposited) where their short sides (widths) are extended to the direction (the main scanning direction, the Y-axis direction) orthogonal to the paper supply direction (the arrow A direction).

On the deep side (the right side in FIG. 4) of the paper supply cassette 5, an inclination separation plate 8 is placed for separating the papers. In such a way that this inclination separation plate 8 protrudes on the central side of the width direction (the Y-axis direction) of the papers P and then backs as it goes to both of the right and left end sides in the width direction of the papers P, it is formed in the convex curved shape when it is viewed from a flat surface. At the center in the width direction of the papers P in the inclination separation plate 8, an elastic separation pad (not shown) having the shape of a saw-tooth is placed in order to be brought into contact with the tip edge of the paper P so that the separation is promoted.

Also, on the side of the body case 2, the base end of a paper supplying arm 6*a* in a paper supplying mechanism 6 is installed so as to be able to rotate in the upper and lower direction. The rotation force from a drive shaft 14 is applied through a gear transmission mechanism, which is installed inside the paper supplying arm 6*a*, to a paper supplying roller 7. Then, with this paper supplying roller 7 and the elastic separation pad of the inclination separation plate 8, the papers P deposited in the paper supply cassette 5 are separated and fed, one by one. The papers P, which are separated so as to advance along the paper supply direction (the arrow A direction), are fed through a lateral U-turn feeding path 9 to a recorder 10 installed on the upper side (higher position) than the paper supply cassette 5.

An ink cartridge 26 for supplying the ink to a recording head 12 (refer to FIG. 5) for color record is configured such that this can be upwardly attached to and detached from an accommodation unit 27 (refer to FIG. 2 and FIG. 3) in an upwardly opened state inside the body case 2. The ink cartridge 26 contains the ink for each of a plurality of colors. In this embodiment, there are four colors of black, cyan, magenta and yellow. However, this may contain the inks of 4 or more colors. The ink is supplied from each ink cartridge 26 to the recording head 12, through an ink tube 28 having flexibility.

Figure 2:
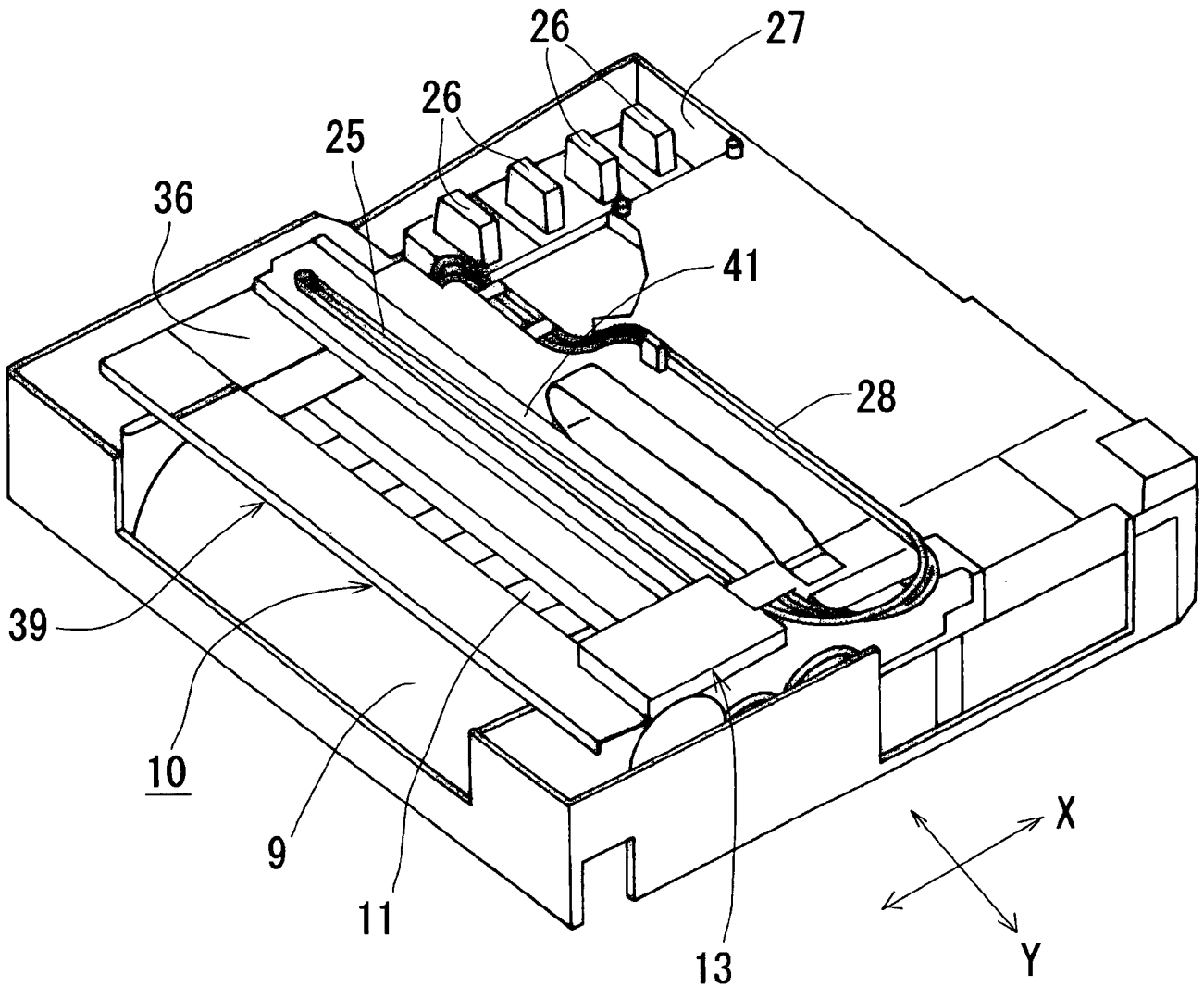
FIG. 2 is a perspective view when a body case in a state that an image reader is removed is viewed from a rear.
Figure 3:
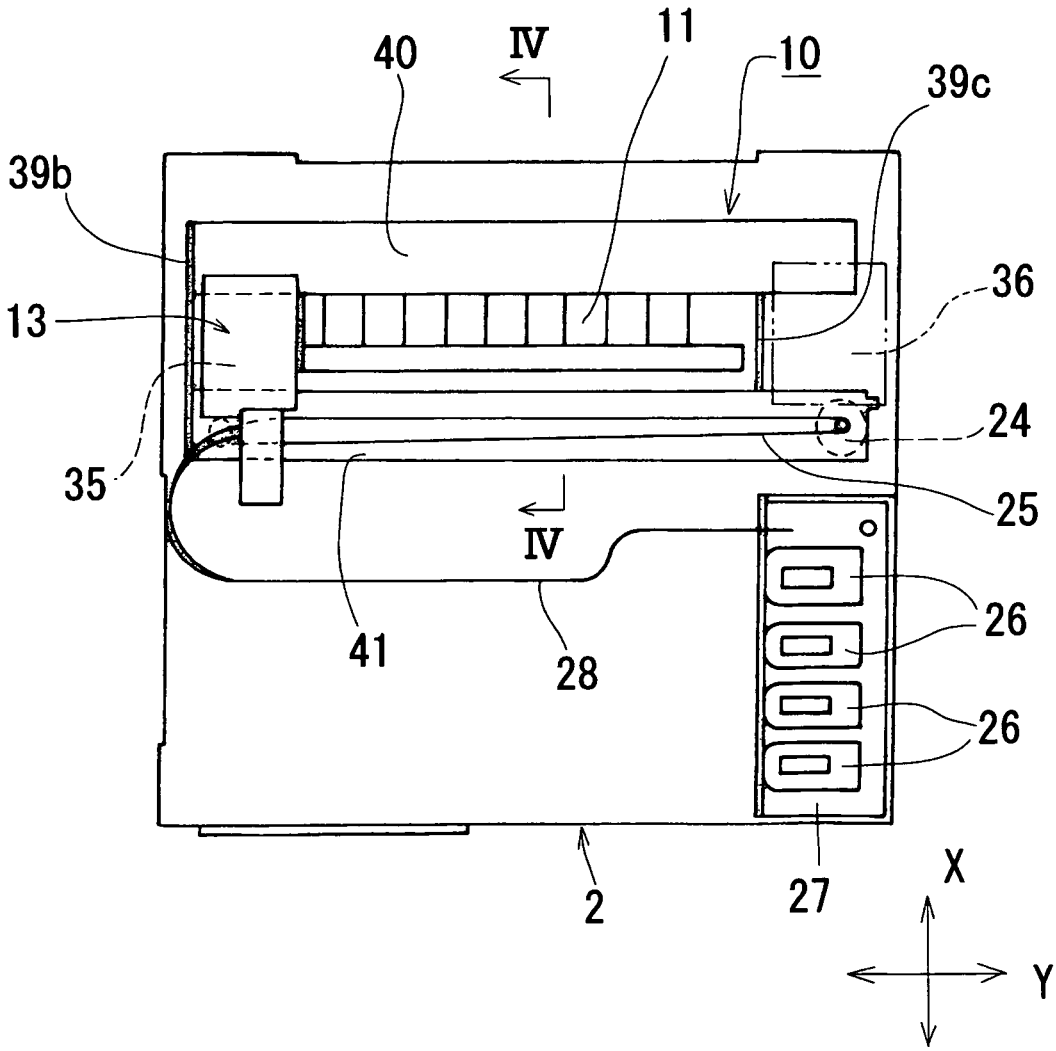
FIG. 3 is a plan view of FIG. 2.
Figure 4:
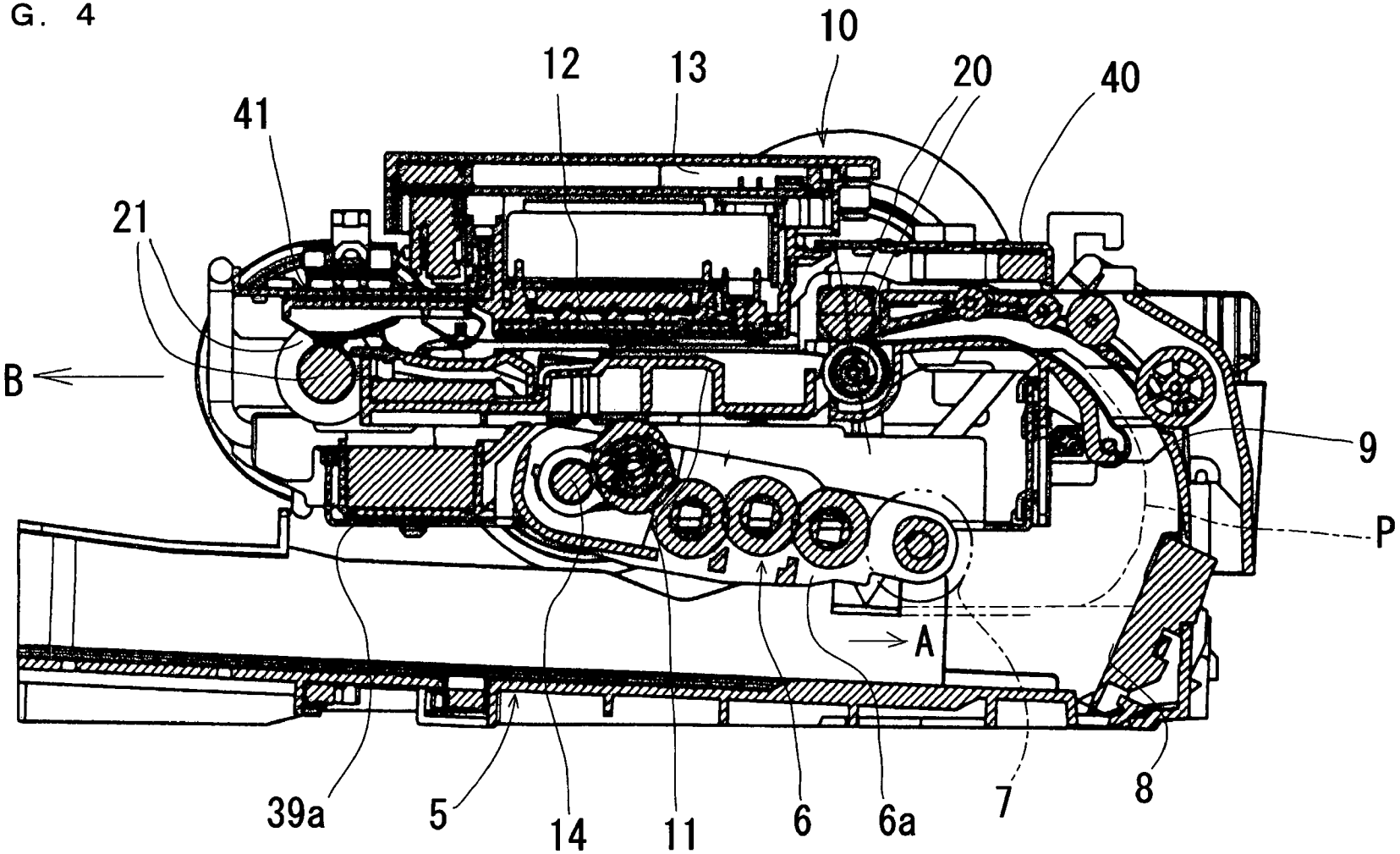
FIG. 4 is an enlarged sectional view on a IV-IV line of FIG. 3.

As shown in FIG. 2 to FIG. 4, the recorder 10 is mainly provided with: a carriage 13 having the recording head 12; a plate-shaped platen 11 that is made of synthetic resin; a CR (carriage) motor 24 for reciprocating the carriage 13; a timing belt 25 connected to this CR motor 24; and an engine frame 39 for supporting them. The engine frame 39 is placed above the paper supply cassette 5 located on the rear side of the body case 2. The engine frame 39 serving as the supporting frame is constituted by a metal plate and contains a pair of guide plates 40, 41, which are extended in the right and left direction (the main scanning direction: the Y-axis direction) of the body case 2 on the upper side of a main unit 39*a* having the shape of a box, as shown in FIG. 2 to FIG. 4, and supports the carriage 13 so that it can be slid. On the top surface of a guide plate 41 placed on the downstream side of a paper expelling direction (an arrow B direction), the timing belt 25 is placed so as to be extended in the main scanning direction (the Y-axis direction). The CR motor 24 for driving this timing belt 25 is fixed to the bottom surface of the guide plate 41. In the guide plate 41, a linear encoder (encoder strip) 37 is placed so as to be extended along its longitudinal direction (the Y-axis direction), and detects the position in the Y-axis direction (the main scanning direction) of the carriage 13 and the movement direction thereof. This band-shaped linear encoder 37 is installed such that the inspection plane (the formation plane of slits arranged at a constant interval in the Y-axis direction) is located along the vertical direction.

The platen 11 having the shape of a flat plate, which rotatably shaft-stops the drive shaft 14 and the arm 6*a* of the paper supplying mechanism 6 and supports the papers P oppositely to the bottom surface of the recording head 12, is installed in the main unit 39*a*. It is noted that the arm 6*a* is always pushed in the downwardly rotational direction by a pushing member such as a torsion spring or the like (not shown).

Also, there are: a resist roller (feeding roller) pair 20 which is placed on the upstream side in the feeding direction with the platen 11 between and feeds the papers P to the bottom surface of the recording head 12; and a paper expelling roller pair 21 which is placed on the downstream side in the feeding direction than the platen 11 and feeds the already-recorded papers P towards the paper expelling unit (refer to the arrow B directions in FIG. 1 and FIG. 4). It is noted that an LF motor 42, which can be rotated in normal and reverse directions, drives the paper supplying units, such as the paper supplying roller 7, the resist roller pair 20, the paper expelling roller pair 21 and the like.

Outside the width of the papers P to be fed (the short side of the papers P), an ink receiver 35 is placed on one end side thereof (in the embodiment, the portion close to a left side plate 39*b* when this is viewed from the paper supply direction of the papers P of the engine frame 39 in FIG. 3, and the left side from the image record region), and a maintenance unit 36 composed of maintenance units is placed on the other end side (the portion close to the right side plate 39*c* in FIG. 3 and the right side from the image record region), respectively. Consequently, the recording head 12 periodically discharges the ink in order to protect the nozzle from being clogged during the recording operation at a flushing position installed in the ink receiver 35, and the ink is received by the ink receiver 35.

If the viscosity of the ink inside the nozzle of the recording head 12 is increased by evaporation or a low temperature, bubbles invade into the nozzle or a common ink room, or foreign materials are deposited on the nozzle surface, the recording head 12 cannot carry out the recording operation normally and stably. So, the maintenance unit 36 contains a suck recovery device 45, which carries out a recovery process and the like, in order to drive the LF motor 42 in a situation that its cap body 50 covers the nozzle surface of the recording head 12 from below, and actuate a sucking pump 47, and selectively suck the ink from the nozzle, and then remove the bubble inside a buffer tank and the common ink room, which are not shown, on the recording head 12.

Figure 5:
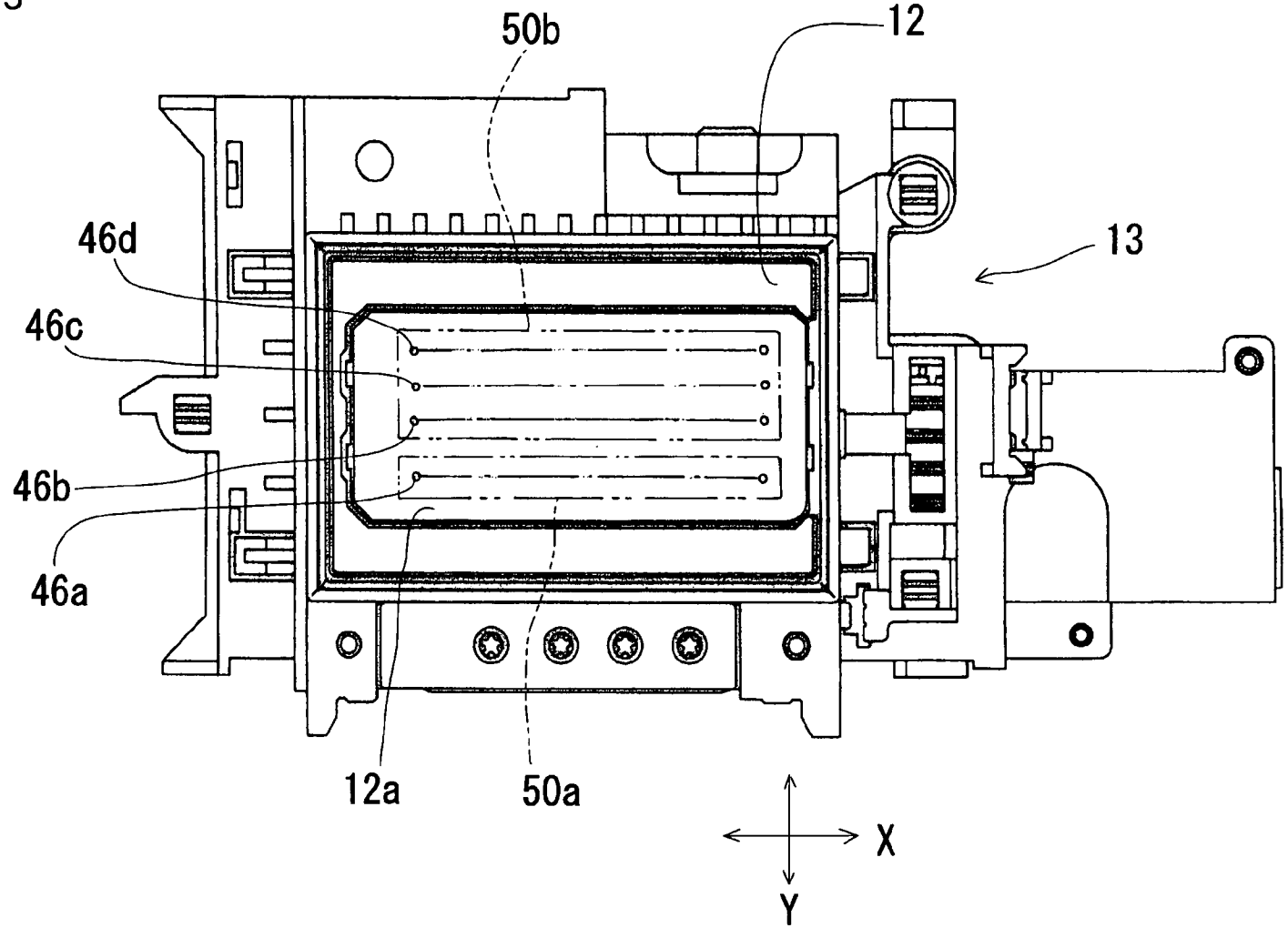
FIG. 5 is a bottom view of a carriage.

FIG. 5 shows the bottom surface of the recording head 12 for many colors in this embodiment. A nozzle row 46*a* composed of a plurality of nozzles for discharging a black ink, and nozzle rows 46*b*, 46*c* and 46*d* composed of a plurality of nozzles for discharging cyan, magenta and yellow inks are arranged at suitable intervals in the main scanning direction (the Y-axis direction). In this embodiment, the nozzle row 46*a* for the black ink is configured such that 75 nozzles per row are arranged at a predetermined interval in the X-axis direction and also arrayed in a staggered manner (thus, a total of 150 nozzles are contained). Each of the nozzle rows 46*b*, 46*c* and 46*d* for the color inks has 75 nozzles.

It is noted that the common ink room (manifold) for transiently holding the ink supplied through the ink tube 28 and individual ink paths which are linked to the common ink room and extended for the respective nozzles are formed inside the recording head 12. In this embodiment, a throttling unit having the highest flow path resistance in the recording head 12 is installed at an outlet of the common ink room to which the individual ink paths are linked. Also, the recording head 12 includes a piezoelectric actuator constituting a part of the individual ink path. Since this piezoelectric actuator is deformed in accordance with an input image data, the ink is discharged from the corresponding nozzle. In short, the series of the flow paths is formed from the ink supply port of the recording head 12 through the common ink room, the throttling unit and the individual ink paths to the nozzles.

Also, in this embodiment, the black ink uses a color matter of a pigment group, and the color ink uses a color matter of a dye group.

A first embodiment of the suck recovery device 45 according to the present invention is shown in FIG. 6A, FIG. 6B and FIGS. 7A to 7C. In this embodiment, a lifting/lowering base 52 is linked through a pair of parallel links 53, 53 onto a base body 51 fixed to the maintenance unit 36 so that it can be lifted and lowered. On the lifting/lowering base 52, the cap body 50 is supported by a guide unit 52*a* so that only its upward/downward action is possible, and the low end of the lifting/lowering base 52 upwardly pushes the cap body 50 by using a first spring 54. Also, the lifting/lowering base 52 and the base body 51 are linked through a second spring 55 that pushes the lifting/lowering base 52 against the image record region side (the left direction in FIG. 6A).

Also, a stopper body 51*a* for defining a downward action limit and a leftward movement limit of the lifting/lowering base 52 is installed on the base body 51. Moreover, the lifting/lowering base 52 contains a contact unit 52*b* which, when the carriage 13 is moved to the right direction, comes into contact with this and lifts this against the pushing force of the second spring 55. It is noted that, when the carriage 13 is moved from the maintenance unit 36 laterally (in an arrow D direction in FIG. 6B) towards the image record region, a wiper body 56 arranged on one side of the base body 51 so that it can be lifted and lowered is used to wipe and clean a nozzle surface 12*a*.

Then, the cap body 50 is divided (grouped) into: a first cap unit 50*a* for covering the portion of the nozzle row 46*a*; and a second cap unit 50*b* for partially covering the portion of the 3 nozzle rows 46*b*, 46*c* and 46*d* for the color inks. The top end that is brought into contact with at least the nozzle surface of the cap body 50 is made of the elastic material such as soft rubber and the like. Consequently, the airtight state can be kept while it is adhered to the nozzle surface 12*a* (corresponding to an open surface of a nozzle of claims) at the top edge of the cap body 50.

Figure 7A:
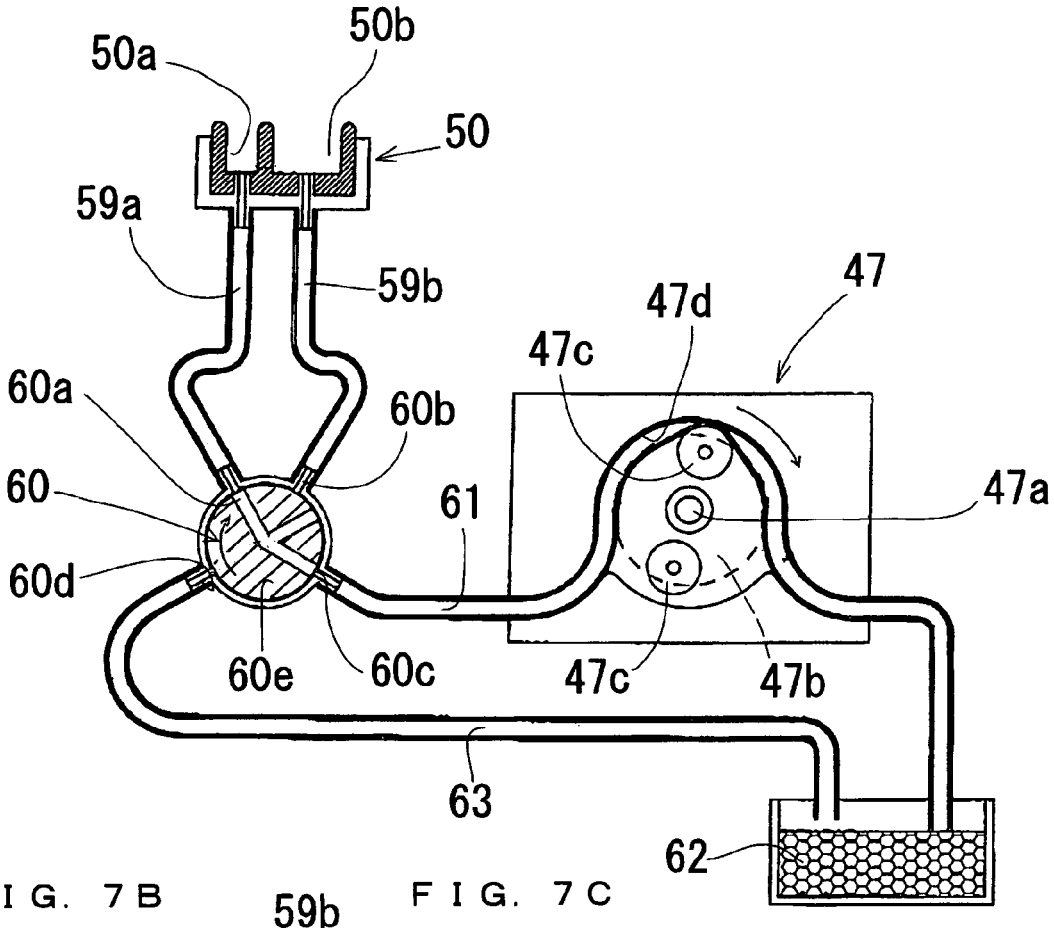
FIG. 7A is a configuration view of the suck recovery device in the first embodiment.

As shown in FIG. 7A, one end of each of flexible tubes 59*a*, 59*b* is connected to each of the cap units 50*a*, 50*b* in the cap body 50, and the other end of the tube 59*a* corresponding to the cap unit 50*a* is connected to a port 60*a* in a rotary type 4-port switching valve 60, and the other end of the tube 59*b* corresponding to the cap unit 50*b* is connected to a port 60*b*. A flexible tube 61 connected to a port 60*c* is one member of the tube type sucking pump 47 serving as a sucking device, and the other end of this tube 61 is connected to or faces on a discard ink absorption body 62 that can hold the unnecessary ink. It is noted that the other end of a flexible tube 63 connected to a port 60*d* is opened to atmosphere. When a valve body 60*e* of the switching valve 60 is rotated by a predetermined angle, this is designed so as to select the first phase (refer to the state of FIG. 7A) where only the port 60*a* and the port 60*c* are linked, the second phase (refer to the state of FIG. 7C) where only the port 60*b* and the port 60*c* are linked, the third phase where only the port 60*d* and the port 60*c* are linked, and the fourth phase (refer to the state of FIG. 7B) in the state that all of the ports are closed (shut off).

As shown in FIG. 7A, the sucking pump 47 contains: a guide roller 47*b* that is rotated with a pump shaft 47*a* as a center; a pressure application roller 47*c* that is shaft-supported so as to be rotatable at the eccentric position of this guide roller 47*b*; and a regulation surface 47*d* which is installed on the outer circumference of the substantially half circle of the guide roller 47*b* and together with the pressure application roller 47*c* crushes a part of the tube 61. Since the guide roller 47*b* and the pressure application roller 47*c* are rotated in the arrow direction in FIG. 7A, the insides of the tubes 61, 59*a* and 59*b* connected to the sides of the cap units 50*a*, 50*b* in the states adhered to the nozzle surface 12*a* become negative in pressure, which will be described later.

Figure 8:
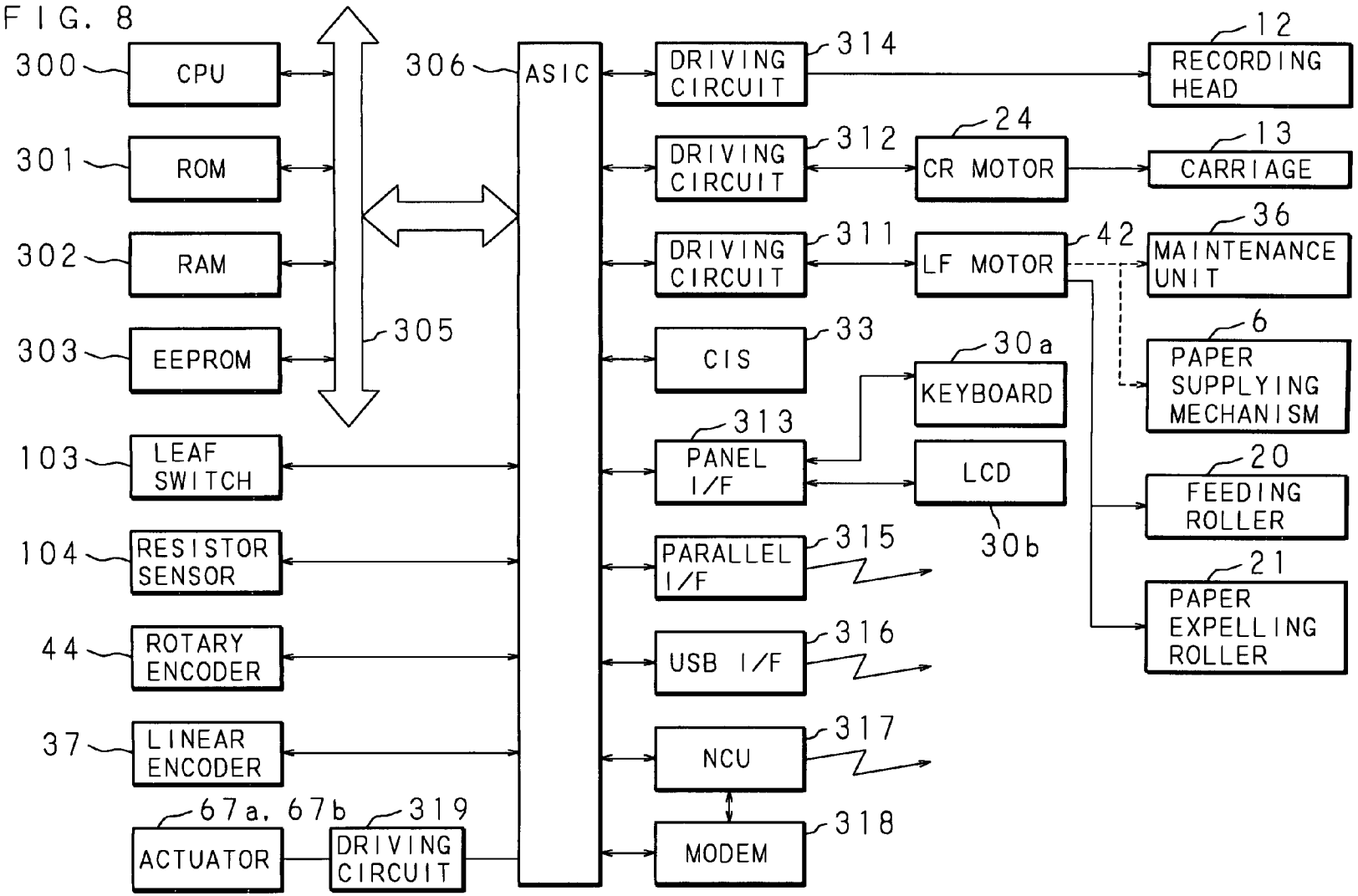
FIG. 8 is a functional block diagram of a controller.

The controller of this image recording apparatus 1 will be explained with reference to FIG. 8. This controller controls the entire operation of the image recording apparatus 1. The controller is configured as a micro computer in which central parts are a CPU 300, a ROM 301, a RAM 302 and an EEPROM 303 and connected through a bus 305 to an ASIC (Application Specific Integrated Circuit) 306.

The ROM 301 stores programs and the like for controlling the various operations of the ink jet printer. The RAM 302 is used as the storage region for transiently storing the various data to be used when the CPU 300 executes those programs, or this is used as the work region. An NCU (Network Control Unit) 317 is connected to the ASIC 306. A communication signal inputted through the NCU 317 from a public line is demodulated by a MODEM 318 and then inputted to the ASIC 306. Also, when the ASIC 306 transmits an image data to outside by using a facsimile transmission or the like, the image data is modulated to the communication signal by the MODEM 318. The communication signal is outputted through the NCU 317 to the public line.

Also, the ASIC 306 generates, for example, a phase excitation signal to be sent to the LF motor 42 and the like, in accordance with a command from the CPU 300, and gives those signals to a driving circuit 311 of the LF motor 42 and a driving circuit 312 of the CR motor 24, and sends the drive signals through the driving circuit 311, the driving circuit 312 and the like to the LF motor 42 and the CR motor 24, and then controls the rotations, stops and the like of the LF motor 42 and the CR motor 24.

Moreover, a scanner device 33 (for example, CIS or the like) for reading the image and character of the draft, a keyboard 30*a* of the operation panel 30 for the transmission/reception operation, a panel interface 313 connected to the liquid crystal display (LCD) 30*b*, and a parallel interface 315, and a USB interface 316 to transmit and receive the data through a parallel cable and a USB cable to an external device such as a personal computer and the like are connected to the ASIC 306.

Moreover, a leaf switch 103 for detecting a rotation position of a cam (not shown) in the maintenance unit 36, a resistor sensor 104 installed in relation to a paper lead detector located on the feeding downstream side of the U-turn feeding path 9 in order to detect the lead position of the papers P when the papers P are supplied so as to approach the portion below the recording head 12 through the U-turn feeding path 9, a rotary encoder 44 for detecting the rotation amount of a feeding roller 20, and a linear encoder 37 for detecting the movement amount in the main scanning direction of the carriage 13 and the movement position (the current position) are connected to the ASIC 306.

A driving circuit 314 is designed such that the ink is selectively discharged to the papers P from the recording head 12 at a predetermined timing, and this receives the signal, which is generated and outputted by the ASIC 306 in accordance with a drive control procedure outputted from the CPU 300, and drive-controls the recording head 12. A driving circuit 319 is designed to turn ON/OFF actuators 67*a*, 67*b*, such as electromagnet solenoids or the like, for actuating first and second cap bodies 64, 65 in a second embodiment which will be described later.

Figure 9A:
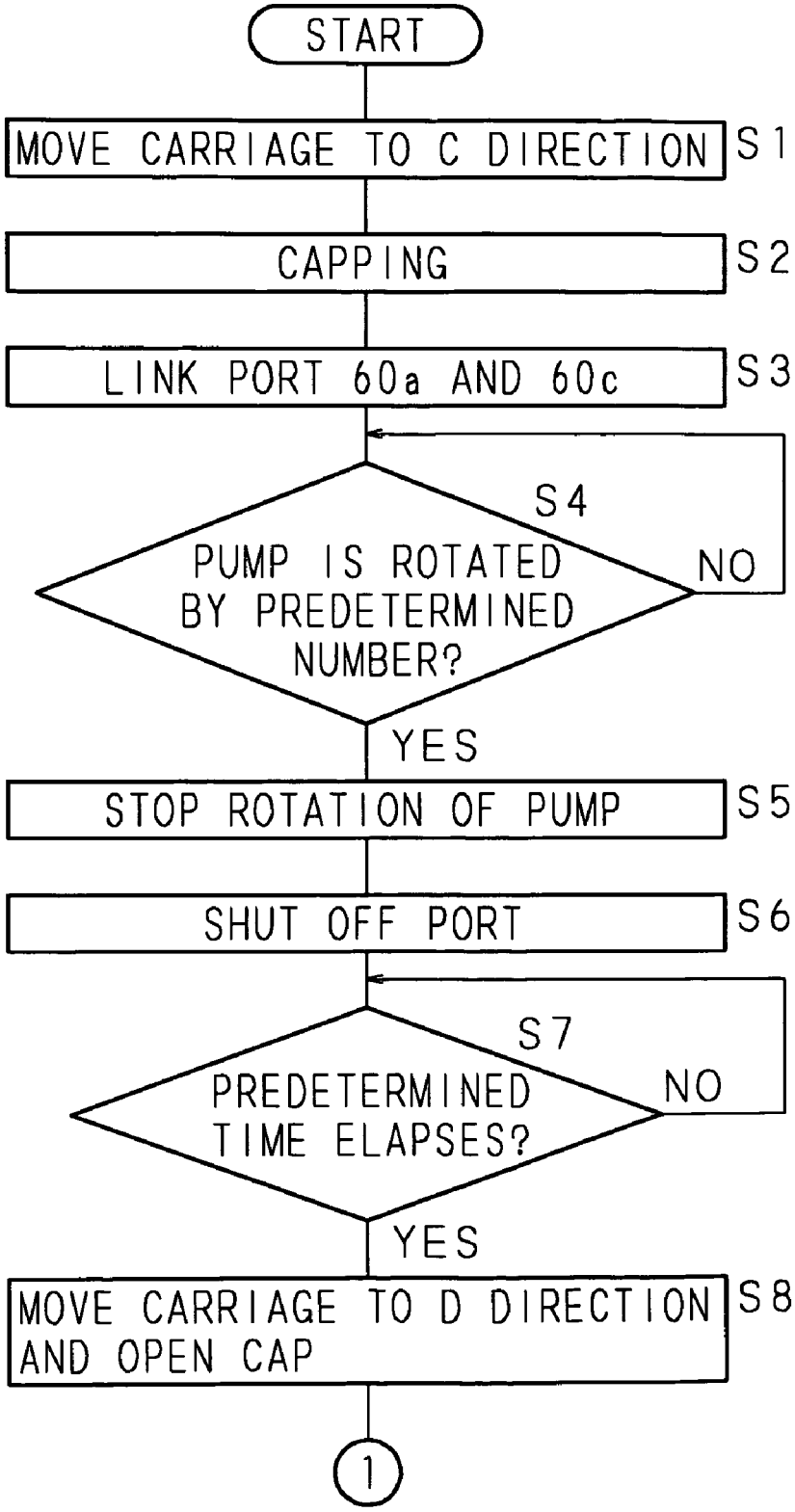
FIGS. 9A and 9B are flowcharts showing a suck recovery control in the first embodiment.
Figure 9B:
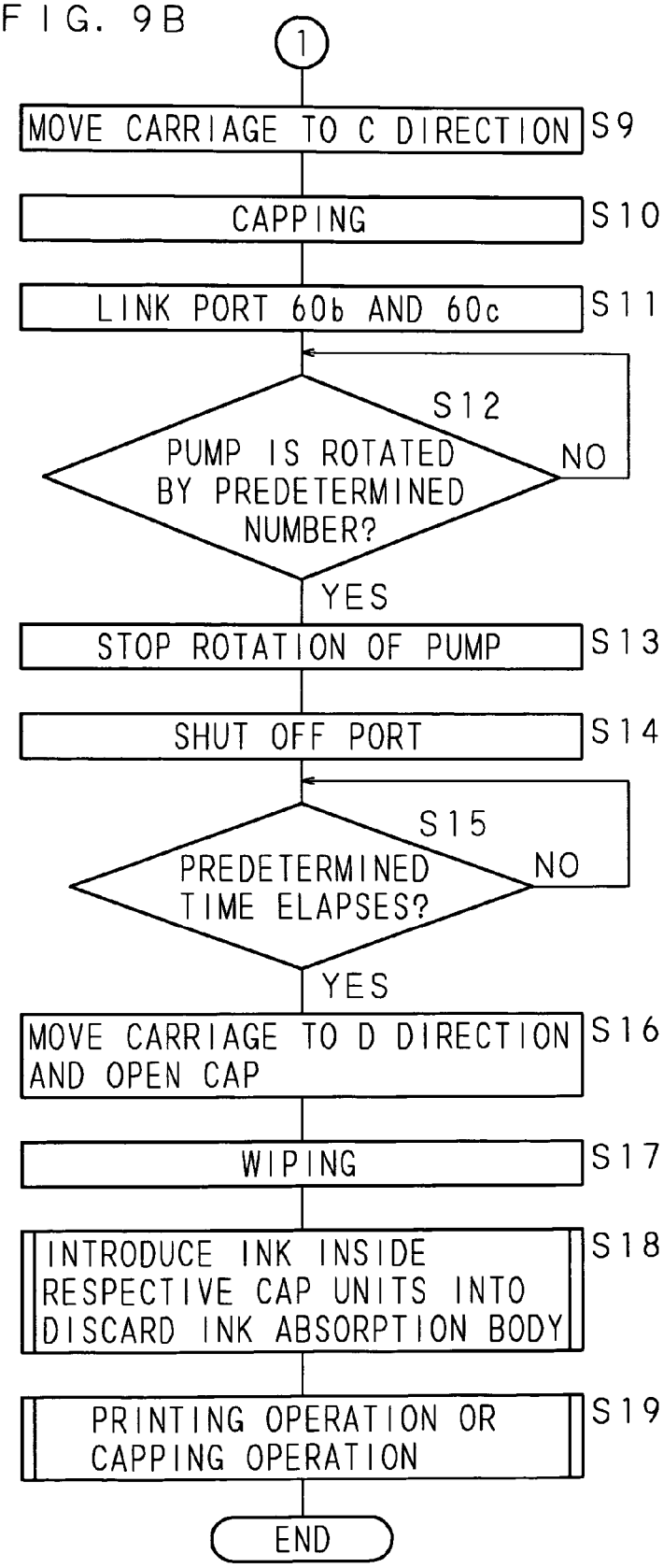

A recovery process control of the recording head 12 to be executed by the controller will be described below with reference to the flowcharts of FIGS. 9A, 9B. For example, in a case that this is not used for a long time, or in a case that the maintenance work is required because the decrease in the remaining ink amount in the course of the image recording procedure requires the exchange of the ink cartridge, the following recovery process is executed.

Figure 6A:
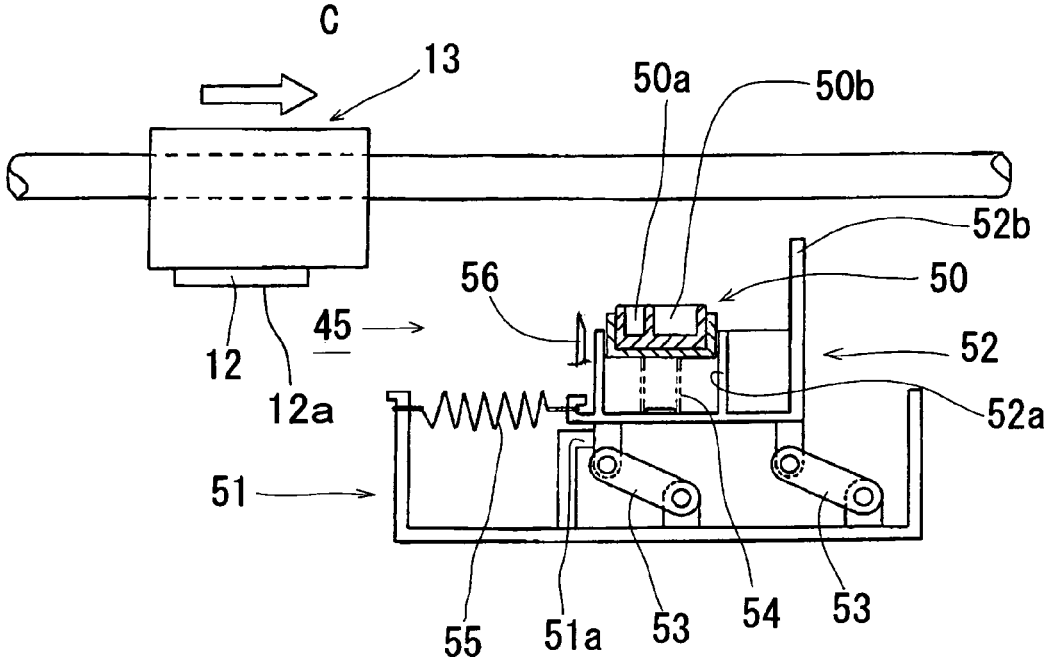
FIG. 6A is an action explanation view showing a situation when the carriage approaches a maintenance unit having a suck recovery device in a first embodiment.

After a process start, the carriage 13 is moved to the arrow C direction (the right direction) of FIG. 6A (S1). When the recording head 12 comes to above the cap body 50 placed in the maintenance unit 36, the right side of the carriage 13 pushes the contact unit 52*b* in the lifting/lowering base 52 to the right direction of FIG. 6A. Then, against the pushing force of the second spring 55, the lifting/lowering base 52 is being moved to the right direction and also moved upwardly by the action of a parallel link 53. Thus, after the top edge of the cap body 50 on the lifting/lowering base 52 is brought into contact with the nozzle surface 12*a* in the recording head 12 on the bottom surface of the carriage 13, only the cap body 50 can be lowered against the elastic force of the first spring 54 irrespectively of the further lifting of the lifting/lowering base 52. Hence, the situation that the top edge of the cap body 50 elastically pushes the nozzle surface 12*a* (the adhered state) can be kept. Consequently, the cap unit 50*a* can cover the nozzle row 46*a* of the black ink, and the cap unit 50*b* can cover the nozzle rows 46*b*, 46*c* and 46*d* of the three rows for the color inks at the same time (refer to FIG. 6B). This is the so-called grouped capping (S2). In this state, the movement of the carriage 13 is stopped.

Next, as shown in FIG. 7A, the switching valve 60 is rotated so as to link the port 60*a* and the port 60*c* (attain the first phase) (S3). The rotation of this switching valve 60 corresponds to the rotation phase of a rotation cam plate (not shown) placed in the maintenance unit 36. Next, since the sucking pump 47 is rotated by a predetermined rotation number (S4: YES), the inner space of the cap unit 50*a* becomes negative in pressure, and the ink begins to be sucked from the nozzle row 46*a* for the black ink.

In order to set the negative pressure of the inner space in the cap unit 50*a* to a predetermined value, a predetermined rotation number of the sucking pump 47 is defined in advance. When the rotation number is large to a certain degree, this negative pressure can be set to a maximum value.

Figure 7B:
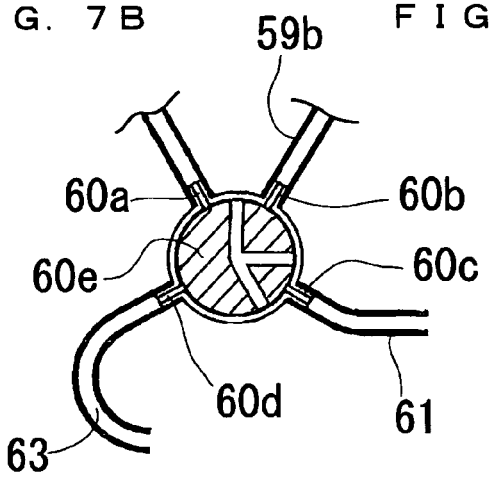
FIG. 7B and FIG. 7C are views showing states of respective phases of a switching valve.

When the negative pressure of the inner space in the cap unit 50*a* becomes the predetermined value, the sucking pump 47 is stopped (S5). In succession, the switching valve 60 is rotated, thereby switching to the fourth phase at which all of the ports are shut off, as shown in FIG. 7B (S6). In this state, the sucking of the ink from the predetermined nozzle row 46*a* is still continued.

It is noted that, even if the ink is sucked, the bubble is apt to remain in the throttling unit whose flow path resistance is high. Thus, the predetermined value of the negative pressure at which the sucking pump 47 is stopped is set such that the flow velocity of the ink enabling the sure removal of the bubble is generated in the throttling unit. The following predetermined times T1, T2 are determined in accordance with the maximum value of the negative pressure of the inner space in the cap units 50*a*, 50*b*.

Whether or not the predetermined time T1 elapses after the rotation stop of the sucking pump 47, namely, after the negative pressure inside the cap unit 50*a* exceeds the predetermined maximum value is judged (S7). If the predetermined time T1 elapses (S7: YES), the carriage 13 is immediately moved from the state of FIG. 6B to the arrow D direction (the left direction) (S8). When one side (right side) of the carriage 13 is separated from the contact unit 52*b* of the lifting/lowering base 52, the lifting/lowering base 52 is lowered by the force of the second spring 55, and the cap unit 50*a* is released from the nozzle surface 12*a* of the recording head 12 and opened (cap release) (S8). This opening of the cap is attained by the slight movement to the left direction of the carriage 13, and the cap release can be rapidly executed. Then, with this cap release, the sucking of the ink from the nozzle row 46*a* is immediately stopped, and the discard ink staying in the inner space of the cap unit 50*a* is held in its original state.

It is noted that there is a case where the negative pressure slightly remains in the inner space of the cap unit 50*a*, depending on the timing of the cap release. However, the force of the second spring 55 is set to the magnitude that enables the cap unit 50*a* to be opened to the atmosphere. Also, the removal of the bubble in the throttling unit depends on the total amount of the inks discharged from the respective nozzles. Thus, the predetermined time T1 is set to be equal to or longer than the time of the completion of the removal of the bubble as mentioned above, in the throttling unit.

Figure 7C:
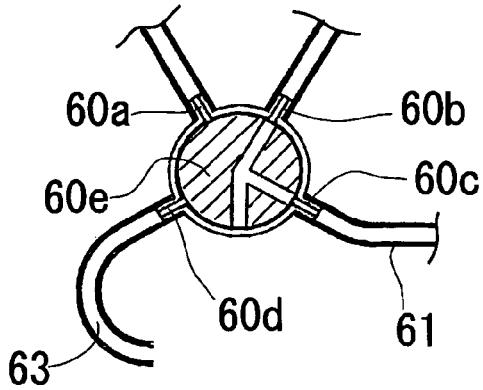

Next, in order to suck the inks from the 3 nozzle rows 46*b*, 46*c* and 46*d* for the color inks, similarly to the step S1, the carriage 13 is again moved to the C direction (S9). Then, similarly to the step S2, the capping for adhering the cap body 50 to the nozzle surface 12*a* is executed (S10). Next, as shown in FIG. 7C, the switching valve 60 is rotated so as to link the port 60*b* and the port 60*c* (attain the second phase) (S11). Next, since the sucking pump 47 is rotated by the predetermined rotation number (S12: YES), the inner space of the cap unit 50*b* becomes negative in pressure, and the inks begin to be sucked from the 3 nozzle rows 46*b*, 46*c* and 46*d* for the color inks.

In order to set the negative pressure of the inner space in the cap unit 50*b*, the predetermined rotation number of the sucking pump 47 is defined in advance. If the rotation number is large to a certain degree, this negative pressure can be defined as the maximum value.

It is noted that in this embodiment, the predetermined value of the negative pressure at this time is set to the same value as the case when the ink is sucked from the nozzle row 46*a* for the black ink as mentioned above. In short, irrespectively of the kind of the color, when the ink is sucked from each of the nozzle rows 46*a*, 46*b*, 46*c* and 46*d*, there is no difference in the flow amount of the ink in the throttling unit.

When the negative pressure of the inner space in the cap unit 50*b* becomes the predetermined value, the sucking pump 47 is stopped (S13). In succession, the switching valve 60 is rotated to switch to the fourth phase at which all of the ports are shut off (S14). For example, the state shown in FIG. 7B corresponds to this. In this state, the sucking of the inks from the predetermined nozzle rows 46*b*, 46*c* and 46*d* is continued.

Whether or not the predetermined time T2 elapses after the rotation stop of the sucking pump 47 is judged (S15). If only the predetermined time T2 elapses (S15: YES), the carriage 13 is immediately moved from the state of FIG. 6B to the arrow D direction (the left direction) (S16). When one side (right side) of the carriage 13 is separated from the contact unit 52*b* of the lifting/lowering base 52, the lifting/lowering base 52 is lowered by the force of the second spring 55, and the cap unit 50*b* is released from the nozzle surface 12*a* of the recording head 12 and opened (cap release) (S16). This opening of the cap is attained by the slight movement to the left direction of the carriage 13, and the cap release can be rapidly executed. Then, with this cap release, the sucking of the inks from the 3 nozzle rows 46*b*, 46*c* and 46*d* is immediately stopped, and the discard ink remaining in the inner space of the cap unit 50*b* is held in its original state. The installation of such an air suck mode protects the discard ink from staying and standing in the inner space of the cap units 50*a*, 50*b* or the cap body 50, and the other parts are never contaminated.

It is noted that the fact where the negative pressure slightly remains in the inner space of the cap unit 50*b* depending on the timing of the cap release is equal to the foregoing case. Also, the facts that the force of the second spring 55 is set to be the magnitude which enables the cap unit 50*b* to be easily opened to the atmosphere and that the predetermined time T2 is set to be equal to or longer than the time of the completion of the removal of the bubble in the throttling unit are equal to the foregoing case. Moreover, the predetermined times T1, T2 are determined correspondingly to the number of the nozzles targeted for the sucking, and the color inks that are larger in the number of the nozzles are longer than the black ink.

Figure 6B:
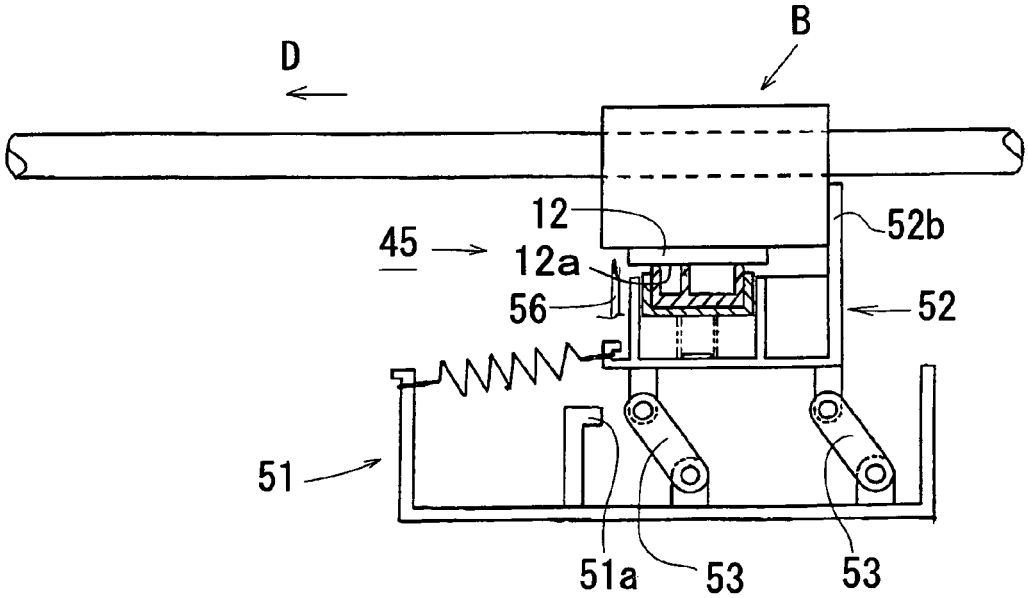
FIG. 6B is an explanation view of a suck recovery action state.

When the recovery operation through the sucking of the ink from the necessary nozzle row is completed, the carriage 13 is moved from the state of FIG. 6B to the arrow D direction, and the wiper body 56 is lifted at that time. Thus, since the nozzle surface 12*a* is slipped on and brought into contact with the tip surface of the wiper body 56, the ink deposited on this nozzle surface 12*a* can be wiped and the cleaning is completed (S17). Also, the discard inks staying inside the respective cap units 50*a*, 50*b* are introduced into the discard ink absorption body 62. Thus, while the valve body 60*e* of the switching valve 60 is sequentially switched to the first phase, the second phase and the third phase, the sucking pump 47 is actuated (S18). Hence, all of the already-discarded inks inside the respective cap units 50*a*, 50*b* and inside the respective tubes

59*a*, 59*b* and 61 can be absorbed into the discard ink absorption body 62. After that, the carriage 13 is returned to the image record region, and the printing operation is executed, or it is returned to the maintenance unit 36, and only the capping operation is executed. Hence, under the situation that the nozzle surface 12*a* is protected from dryness, it can be set at the wait state (S19.)

The predetermined time T1 until the cap release in the foregoing one cap unit 50*a* and the predetermined time T2 until the cap release in the other cap unit 50*b* can be made different as mentioned above. The suck amount of the ink in each of the cap units is proportional to the value of the negative pressure, which is changed with time inside the cap, and the integral value of the time until the cap release after the suck start. Thus, depending on the long or short setting of those predetermined times, as mentioned above, it is possible to carry out the cap release in any time band (time point) exceeding the maximum suck negative pressure, or it is possible to reversely carry out the cap release prior to the arrival at the maximum suck negative pressure.

Thus, in accordance with the ink characteristics such as the large or small aperture diameter of each nozzle for each nozzle row, the large or small total number of the nozzles, and the strong or weak viscosity of the ink and the like, the grouping is carried out, thereby enabling the adjustment of the time (predetermined time) of the cap release (cap open), and enabling the optimization of the suck amount of the ink for each group, and disabling the useless ink sucking. Also, since the predetermined times T1, T2 are differently determined, the suck amount of the ink for each nozzle row can be optimized as compared with the operation for covering the plurality of nozzle rows in the recording head 12 at the same time and simultaneously executing the ink sucking operations. Thus, the useless ink sucking can be removed.

Also, as compared with the conventional operation for releasing the negative pressure caused by the switching valve installed in the middle of the tube through which the sucking pump and the cap body are connected (opening the inner space of the cap unit so that it becomes at the ambient pressure), only the movement along the main scanning direction of the carriage 13 enables the executions of the capping and the cap release. Thus, the rapid recovery operation can be expected. In particular, the remarkable effect that the recovery operation time including the post-wiping operation can be reduced is provided.

In this embodiment, the configuration of: the lifting/lowering base 52 for lifting and lowering the contact unit 52*b* with which the carriage 13 is brought into contact; the second spring 55; and the parallel link 53 corresponds to the cap body driver. Also, the configuration for controlling the movement along the main scanning direction of the carriage 13 corresponds to the controller which controls a timing when the cap body driver switches the position of the cap body from the first position where the cap body is in contact with the open surfaces of the nozzles to the second position where the cap body is separated from the open surfaces of the nozzles, on the basis of the ink amount to be sucked from the nozzles.

Figure 10:
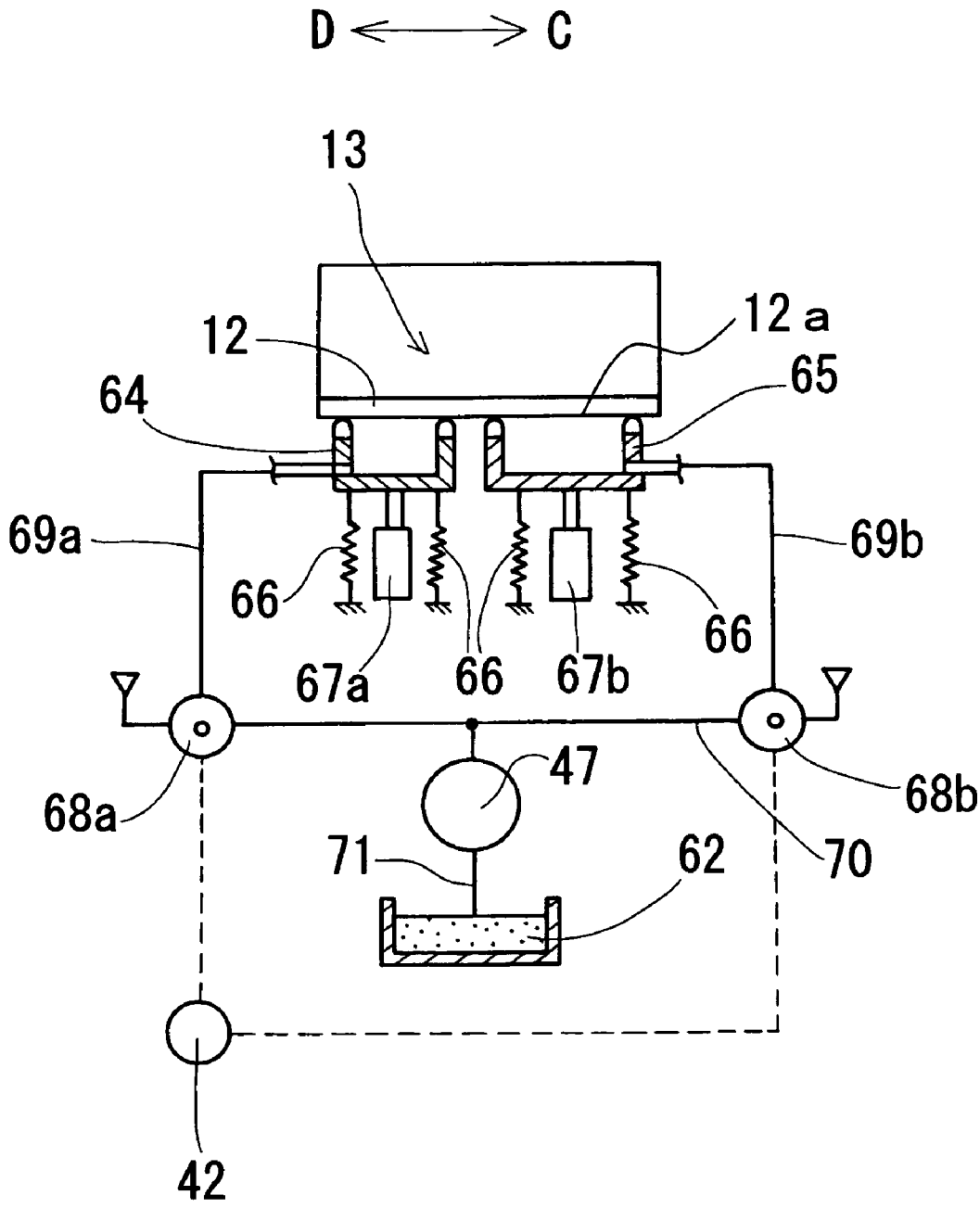
FIG. 10 is an explanation view showing a configuration of a suck recovery device in a second embodiment.

FIG. 10 shows a second embodiment of the suck recovery device. In this embodiment, it is divided into: a first cap body 64 correlated to the nozzle row 46*a* for the black ink; and a second cap body 65 correlated to the 3 nozzle rows 46*b*, 46*c* and 46*d* for the color inks. The respective cap bodies 64, 65 are individually arranged such that they can be only lifted and lowered. It is noted that the top end (the portion to be brought into contact with the nozzle surface 12*a*) of each of the cap bodies 64, 65 is constituted by at least elastic material such as soft rubber and the like.

The respective cap bodies 64, 65 are downwardly pushed (to the direction separated from the nozzle surface 12*a* in the recording head 12 located at the maintenance unit 36) by a spring 66. On the other hand, this is configured such that the respective cap bodies 64, 65 are upwardly protruded by the actuators 67*a*, 67*b*, such as the electromagnetic solenoids or the like, in accordance with a predetermined command signal.

Also, the respective cap bodies 64, 65 are connected through tubes 69*a*, 69*b* to individual switching valves 68*a*, 68*b*, and the respective switching valves 68*a*, 68*b* are connected through a tube 70 to one sucking pump 47 and connected from this sucking pump 47 through a tube 71 to the discard ink absorption body 62. Then, the respective switching valves 68*a*, 68*b* are switching-controlled by the actuator such as the LF motor 42 and the like. The respective switching valves 68*a*, 68*b* are the rotary type similar to the first embodiment and configured to be able to be switched from the first phase until the fourth phase.

Figure 11A:
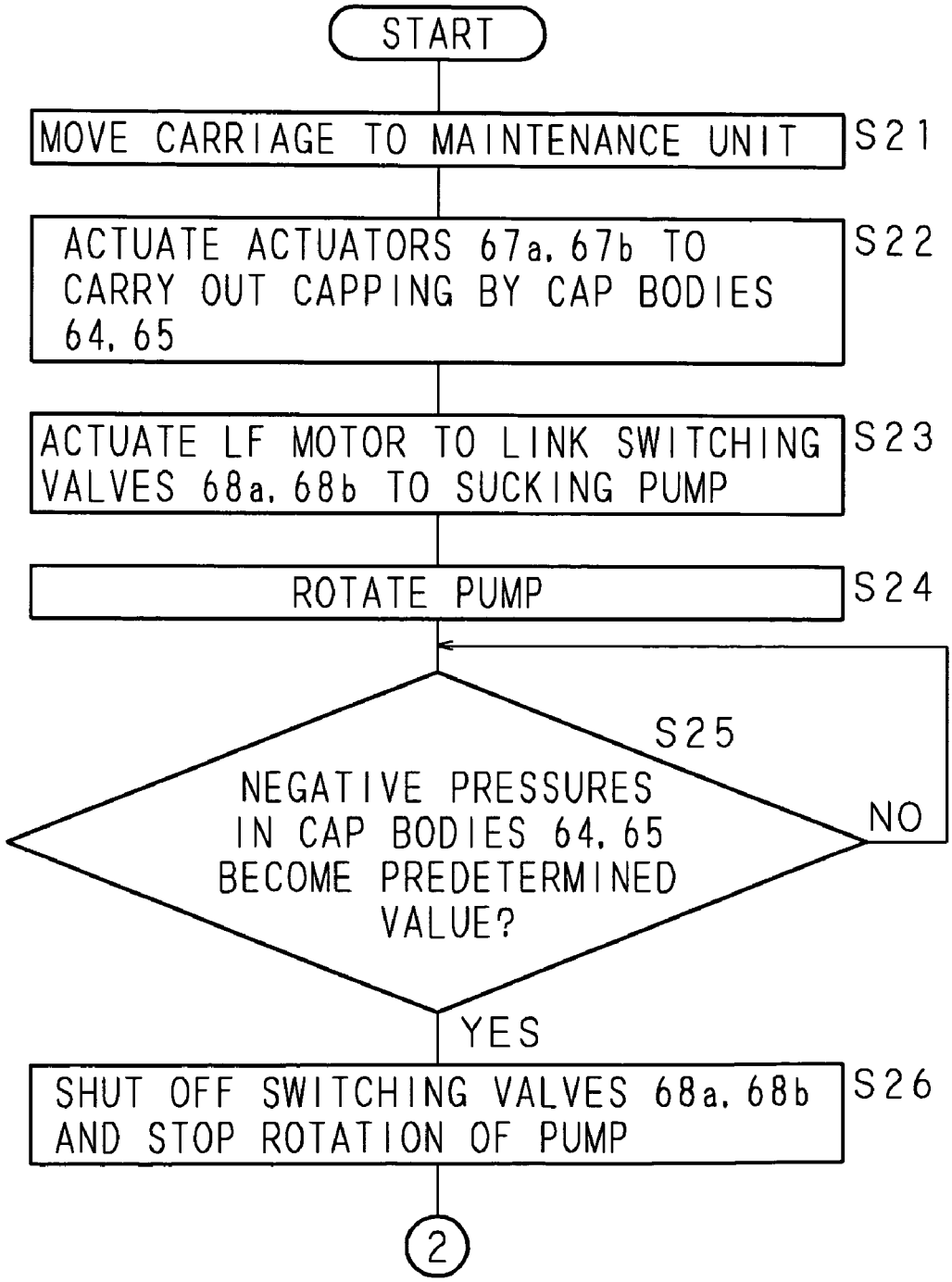
FIGS. 11A and 11B are flowcharts of a suck recovery control in the second embodiment.
Figure 11B:
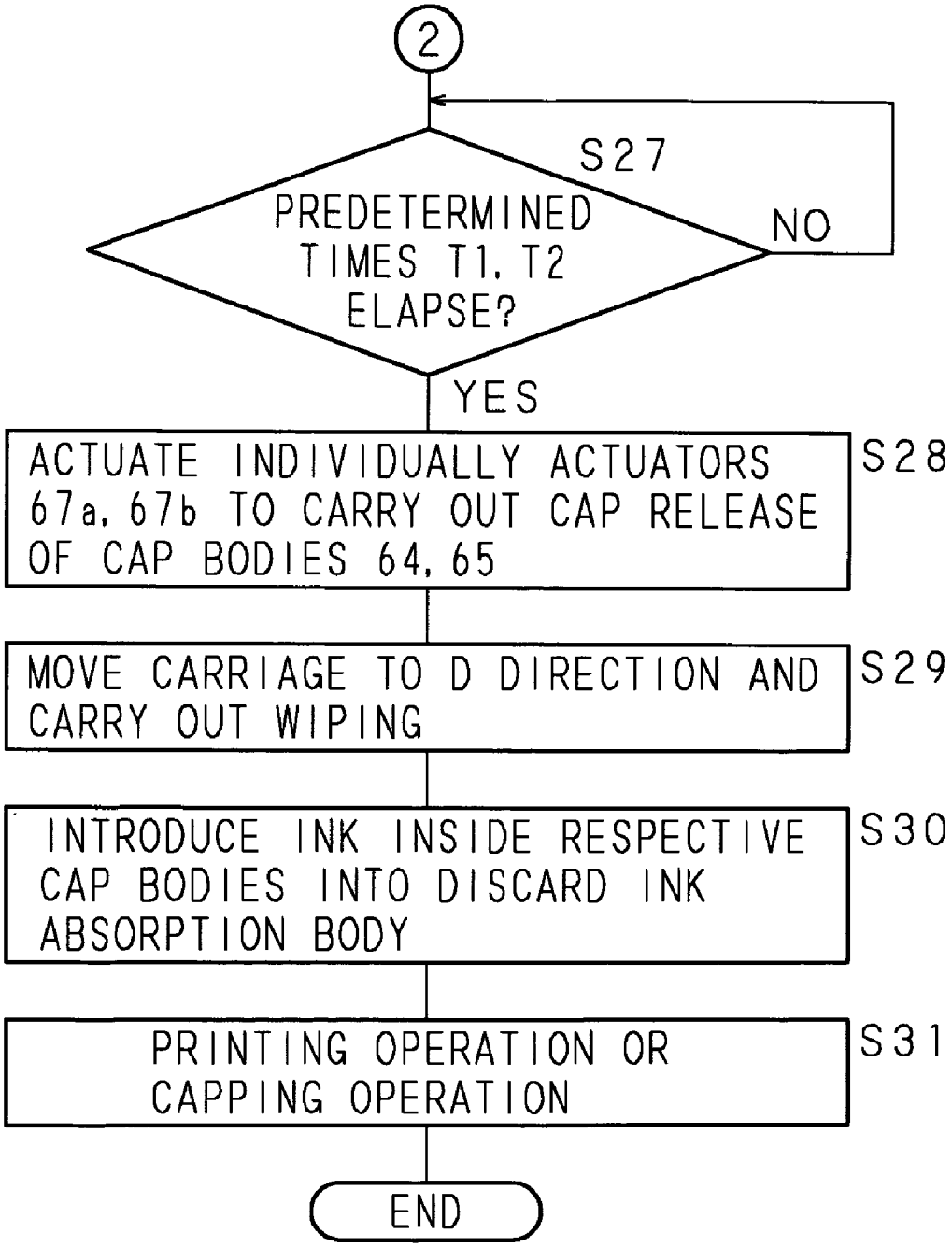

The control manner of the suck recovery device in this second embodiment will be described below in accordance with the flowcharts shown in FIGS. 11A, 11B. After the process start, the carriage 13 is moved to the arrow C direction (the right direction) of FIG. 10. Then, above the cap bodies 64, 65 arranged in the maintenance unit 36, when the group of each nozzle row 46*a* of the recording head 12 and the group of the 3 nozzle rows 46*b*, 46*c* and 46*d* come to the corresponding positions, it is stopped (S21).

Next, the actuators 67*a*, 67*b* are actuated to adhere the respective cap bodies 64, 65 to the nozzle surface 12*a* and cap them (S22). Next, the LF motor 42 is actuated such that both of the switching valves 68*a*, 68*b* are linked to the sucking pump 47 (S23). In succession, the sucking pump 47 is rotated, and the sucking is started such that the inner spaces in the respective cap bodies 64, 65 become negative in pressure (S24). Consequently, the black ink begins to be sucked from the nozzle row 46*a* to the first cap body 64, and the respective inks begin to be sucked from the 3 nozzle rows 46*b*, 46*c* and 46*d* for the color inks to the second cap body 65.

In order to set the negative pressures of the respective inner spaces in the first and second cap bodies 64, 65 to a predetermined value, a predetermined rotation number of the sucking pump 47 is defined in advance. When the rotation number is large to a certain degree, this negative pressure can be set to a maximum value.

When the negative pressures of the inner spaces in the respective cap bodies 64, 65 become the predetermined value (S25:YES), the respective switching valves 68*a*, 68*b* are shut off, and the sucking pump 47 is then stopped (S26). In this state, the sucking of the inks from the respective nozzle rows 46*a* to 46*d* is still continued.

Whether or not the predetermined times T1, T2 elapse after the rotation stop of the sucking pump 47 is judged (S27). If the predetermined time T1 elapses, the actuator 67*a* is actuated to separate the first cap body 64 from the nozzle surface 12*a*, and if the predetermined time T2 elapses, the actuator 67*b* is actuated to separate the second cap body 65 from the nozzle surface 12*a*. As mentioned above, they are individually actuated to carry out the cap release (S28). With this cap release, the sucking of the ink is immediately stopped, and the discard inks respectively remaining in the inner spaces of the respective cap bodies 64, 65 are held in their original states.

After the cap release, the carriage 13 is immediately moved from the state of FIG. 10 to the arrow D direction (the left direction). If a wiper body (not shown) is lifted at that time, the wiping can be executed (S29).

In succession, in order to introduce the discard inks staying inside the respective cap bodies 64, 65 into the discard ink absorption body 62, while the switching valves 68*a*, 68*b* are sequentially switched to the first phase, the second phase and the third phase, the sucking pump 47 is actuated. Thus, all of the already-discarded inks inside the respective cap bodies 64, 65 and inside the respective tubes can be absorbed into the discard ink absorption body 62 (S30). Since the air suck mode is installed as mentioned above, the other parts are never contaminated. After that, the carriage 13 is returned to the image record region, and the printing operation is executed, or it is returned to the maintenance unit 36, and only the capping operation is executed. Consequently, under the situation that the nozzle surface 12*a* is protected from dryness, it can be set at the wait state (S31).

Also in this embodiment, the predetermined time T1 until the cap release in the foregoing one cap body 64 and the predetermined time T2 until the cap release in the other cap body 65 can be made different as mentioned above. The suck amount of the inks in the respective cap bodies is proportional to the value of the negative pressure, which is changed with time inside the cap, and the integral value of the times until the cap release after the sucking start. In this embodiment, the actuators 67*a*, 67*b* for the cap release and the spring 66 for pushing to the release direction correspond to the cap body driver, and serves as the controller where the action control for the actuators 67*a*, 67*b* can be changed in accordance with the ink amount to be sucked from the nozzle. Thus, depending on the long or short setting of this predetermined time, it is possible to carry out the cap release in any time band (time point) exceeding the maximum suck negative pressure, or it is possible to reversely carry out the cap release prior to the arrival at the maximum suck negative pressure.

In the second embodiment, the cap bodies 64, 65 are separated so as to be able to be connected and separated for each group where the plurality of nozzles are grouped into the plurality of groups, and the timing when the position of each of the cap bodies 64, 65 is switched from the first position to the second position is controlled on the basis of the ink amount to be sucked from the nozzles. Thus, the effect that the configurations of the cap body driver for the cap release and the controller can be simplified. Also, the predetermined times T1, T2 are differently determined in accordance with the ink characteristics such as the large or small aperture diameter of each nozzle for each nozzle row, the large or small total number of the nozzles, and the strong or weak viscosity of the ink and the like. Thus, as compared with the work for covering the plurality of nozzle rows in the recording head 12 at the same time and simultaneously executing the ink sucking operations, the suck amount of the ink for each nozzle row can be optimized, thereby removing the useless ink sucking.

Also, as compared with the conventional work for releasing the negative pressure caused by the switching valve installed in the middle of the tube through which the sucking pump and the cap body are connected (opening the inner space of the cap unit so that it becomes at the ambient pressure), the remarkable effect that the recovery operation time including the wiping operation after the cap release can be reduced is provided.

In the first and second embodiments, the timing when the position of the cap body is switched from the first position to the second position is determined in accordance with the high or low setting value of the maximum negative pressure of the suck pressure at which the ink is sucked. If the maximum negative pressure is high, it is easy to increase the ink amount to be sucked. If so, even if the timing (the predetermined time) until the cap release after the suck start is set equal, it is easy to make the ink amounts to be sucked for each group different from each other.

In the case of the flow path state of the same dimension except the aperture diameter of the nozzle, as the aperture diameter of the nozzle is larger, the maximum suck negative pressure is set to be smaller, as compared with the case that the aperture diameter of the nozzle is small. This is because if the aperture diameter of the nozzle is larger, the flow path resistance of the flow path to the nozzle becomes smaller, as compared with the flow path where the aperture diameter of the nozzle is smaller. If the flow path resistance is small, the ink is easily discharged. However, correspondingly thereto, it is easy to reserve the predetermined flow velocity in the throttling unit. Even if the maximum suck negative pressure is set low, the predetermined flow velocity is reserved in the throttling unit. Reversely, if the aperture diameter of the nozzle is small, the flow path resistance becomes high as a whole. Correspondingly thereto, in order to reserve the predetermined flow velocity in the throttling unit, the maximum suck negative pressure is required to be made higher.

Also, the setting value of the maximum negative pressure of the ink suck pressure is set to be higher, as the number of the nozzles is larger. Also, in the case of the color ink, it is set to be higher than that of the black ink. Typically, as the setting standard in the case that the timing (predetermined time) until the cap release after the suck start is set by grouping the cap units in one cap body or grouping for each plurality of cap bodies, the maximum negative pressure of the ink suck pressure is suitable.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalent of such metes and bounds thereof are therefore intended to be embraced by the claims.

What is claimed is:

1. An image recording apparatus, comprising:

an ink jet head having a plurality of nozzles for discharging inks;

a cap body having an inner space and adapted to cover open surfaces of said nozzles such that the inner space forms a sealed space;

a sucking device which is connected to the inner space of said cap body and sucks the ink from said nozzles;

a cap body driver which switches a position of said cap body between a first position where said cap body is in contact with the open surfaces of said nozzles and a second position where said cap body is separated from the open surfaces of said nozzles; and a controller which controls a timing when the cap body driver switches the position of said cap body from the first position to the second position, on the basis of an ink amount to be sucked from said nozzles;

wherein said timing is determined in accordance with a setting value of a negative pressure of a suck pressure at which the ink is sucked; and wherein the setting value of the maximum negative pressure of the ink suck pressure is set to be smaller, as an aperture diameter of the nozzle is larger.

2. The image recording apparatus according to claim 1;

wherein the ink remaining in said cap body is sucked by using said sucking device, when said cap body is present at the second position.

3. The image recording apparatus according to claim 1;

wherein the inner space of said cap body is divided such that it can be sucked for each group where said plurality of nozzles are grouped into a plurality of groups; and said sucking device has one sucking pump and switching valves for switching a linkage/shut-off between said sucking pump and said each divided inner space.

4. The image recording apparatus according to claim 3;

wherein the group of said plurality of nozzles is grouped on the basis of the aperture diameter of the nozzle, the number of the nozzles, or the characteristic of the ink to be discharged.

5. The image recording apparatus according to claim 4;

wherein the setting value of the negative pressure of the ink suck pressure is set to be smaller, as an aperture diameter of the nozzle is larger.

6. The image recording apparatus according to claim 3;

wherein the setting value of the negative pressure of the ink suck pressure is set to be smaller, as an aperture diameter of the nozzle is larger.

7. The image recording apparatus according to claim 3;

wherein the ink remaining in said cap body is sucked by using said sucking pump, when said cap body is present at the second position.

8. An image recording apparatus, comprising:

an ink jet head having a plurality of nozzles for discharging inks;

a cap body having an inner space and adapted to cover open surfaces of said nozzles such that the inner space forms a sealed space;

a sucking device which is connected to the inner space of said cap body and sucks the ink from said nozzles;

a cap body driver which switches a position of said cap body between a first position where said cap body is in contact with the open surfaces of said nozzles and a second position where said cap body is separated from the open surfaces of said nozzles; and a controller which controls a timing when the cap body driver switches the position of said cap body from the first position to the second position, on the basis of an ink amount to be sucked from said nozzles;

wherein said timing is determined in accordance with a setting value of a negative pressure of a suck pressure at which the ink is sucked;

wherein said cap body is separated so as to be able to be connected and separated for each group where said plurality of nozzles are grouped into a plurality of groups;

wherein said controller controls the timing when the position of each cap body is switched from the first position to the second position, on the basis of the ink amount to be sucked from said nozzles; and wherein said sucking device simultaneously executes the sucking operation with respect to the each group of nozzles covered by the plurality of cap bodies.

9. The image recording apparatus according to claim 8;

wherein the group of said plurality of nozzles is grouped on the basis of the aperture diameter of the nozzle, the number of the nozzles, or the characteristic of the ink to be discharged.

10. The image recording apparatus according to claim 9;

wherein the setting value of the negative pressure of the ink suck pressure is set to be smaller, as an aperture diameter of the nozzle is larger.

11. The image recording apparatus according to claim 8;

wherein the setting value of the negative pressure of the ink suck pressure is set to be smaller, as an aperture diameter of the nozzle is larger.

12. The image recording apparatus according to claim 8;

wherein the ink remaining in said cap body is sucked by using said sucking device, when said cap body is present at the second position.

13. An image recording apparatus, comprising:

an ink jet head having a plurality of nozzles for discharging inks;

a cap body having an inner space and adapted to cover open surfaces of said nozzles such that the inner space forms a sealed space;

a sucking device which is connected to the inner space of said cap body and sucks the ink from said nozzles;

a cap body driver which switches a position of said cap body between a first position where said cap body is in contact with the open surfaces of said nozzles and a second position where said cap body is separated from the open surfaces of said nozzles;

a controller which controls a timing when the cap body driver switches the position of said cap body from the first position to the second position, on the basis of an ink amount to be sucked from said nozzles; and a carriage for mounting the ink jet head, the carriage reciprocating over a record region and a region in which the cap body is arranged;

wherein said timing is determined in accordance with a setting value of a negative pressure of a suck pressure at which the ink is sucked;

wherein the cap body driver includes a link mechanism for performing a connecting and separating operation of the cap body in accordance with a position of the carriage;

wherein the controller separates the cap body from an open surface of the nozzle by moving the carriage at the timing in a direction departing from the region in which the cap body is arranged; and wherein the link mechanism includes:

a lift/lowering base having a cap body mounted thereon, and a contact unit which is brought into contact with the carriage; and a link for changing movement in a scanning direction of the carriage received by the contact unit to movement in a connecting and separating direction of the cap body.

* * * * *